US009188284B2

(12) United States Patent
Luo et al.

(10) Patent No.: US 9,188,284 B2
(45) Date of Patent: Nov. 17, 2015

(54) NATURAL GAS ADSORPTION DEVICES

(71) Applicants: Nie Luo, Savoy, IL (US); Ji Cui, Aurora, IL (US); Lizhang Yang, ZhengZhou (CN)

(72) Inventors: Nie Luo, Savoy, IL (US); Ji Cui, Aurora, IL (US); Lizhang Yang, ZhengZhou (CN)

(73) Assignee: Luon Energy LLC, Savoy, IL (US)

( * ) Notice: Subject to any disclaimer, the term of this patent is extended or adjusted under 35 U.S.C. 154(b) by 179 days.

(21) Appl. No.: 13/686,050

(22) Filed: Nov. 27, 2012

(65) Prior Publication Data

US 2013/0220479 A1 Aug. 29, 2013

Related U.S. Application Data

(60) Provisional application No. 61/604,526, filed on Feb. 29, 2012, provisional application No. 61/694,757, filed on Aug. 29, 2012.

(51) Int. Cl.
*F17C 1/00* (2006.01)
*F17C 5/06* (2006.01)

(52) U.S. Cl.
CPC .... *F17C 1/00* (2013.01); *F17C 5/06* (2013.01)

(58) Field of Classification Search
CPC ..... F17C 1/00; F17C 58/06
See application file for complete search history.

(56) References Cited

U.S. PATENT DOCUMENTS

| | | | | |
|---|---|---|---|---|
| 6,503,584 | B1 | 1/2003 | McAlister | |
| 2002/0117123 | A1 * | 8/2002 | Hussain et al. | 123/3 |
| 2006/0280993 | A1 | 12/2006 | Keefer et al. | |
| 2008/0203101 | A1 | 8/2008 | Kimbara et al. | |
| 2008/0283411 | A1 | 11/2008 | Eastman et al. | |
| 2009/0282839 | A1 * | 11/2009 | Sigal | 62/46.3 |

FOREIGN PATENT DOCUMENTS

WO WO 2011/159259 12/2011

OTHER PUBLICATIONS

Int'l. Search Report and Written Opinion dated Jun. 21, 2013 for PCT App. Ser. No. PCT/US2013/027645, 17 pages.
Peter Pfeifer, "Advanced Nanoporous Carbon from Corncob for Vehicular Natural Gas and Hydrogen Storage", All-Craft Progress Report—Aug. 12, 2006.

* cited by examiner

*Primary Examiner* — Christopher P Jones
(74) *Attorney, Agent, or Firm* — Fish & Richardson P.C.; Tony Zhang

(57) ABSTRACT

This disclosure relates to a natural gas absorption device that includes (1) at least one porous, flexible container that has an average pore diameter and is permeable to natural gas, (2) a natural gas absorption material at least partially disposed in the container, the material having a volume average diameter larger than the average pore diameter of the container, and (3) a storage tank having an opening, the tank enclosing the container and the natural gas absorption material.

16 Claims, 5 Drawing Sheets

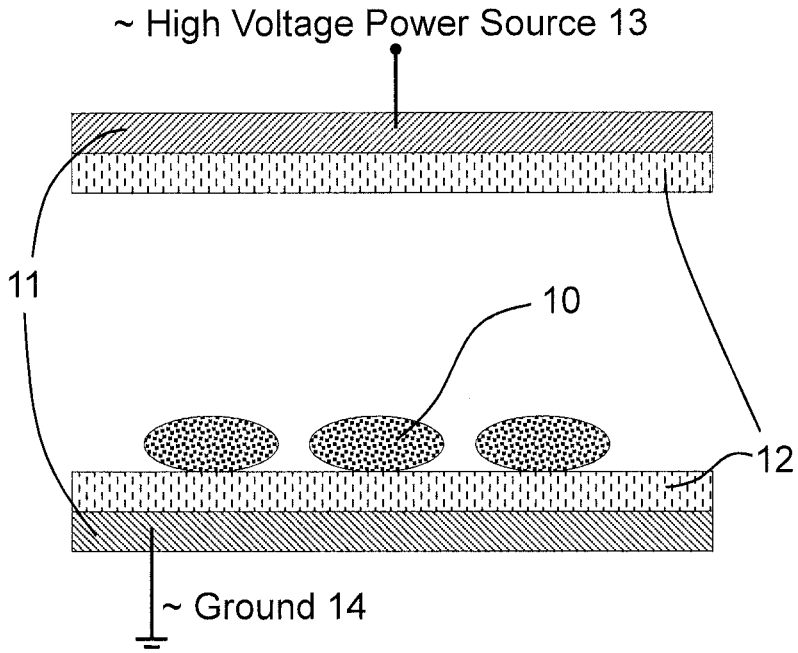
Figure 4
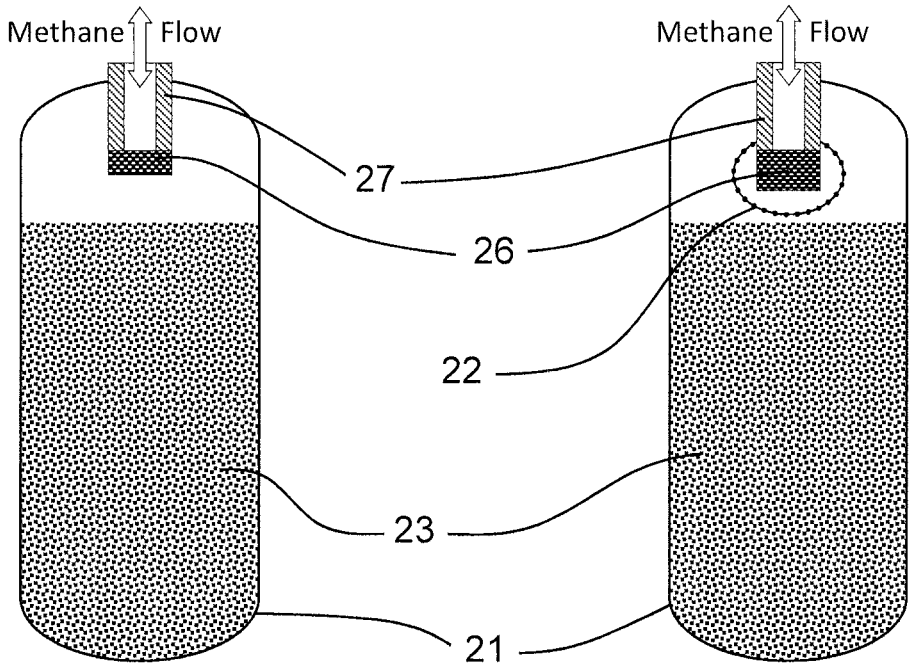
Figure 5a
Figure 5b

NATURAL GAS ADSORPTION DEVICES

CROSS-REFERENCE TO RELATED APPLICATIONS

The present application claims priority under 35 U.S.C. §119 to U.S. Provisional Patent Application No. 61/604,526, filed Feb. 29, 2012, and U.S. Provisional Patent Application No. 61/694,757, filed Aug. 29, 2012. The contents of the prior applications are hereby incorporated by reference in their entirety.

TECHNICAL FIELD

This disclosure relates to natural gas adsorption devices, as well as related components, systems, vehicles, and methods.

BACKGROUND

Natural gas is one of the most promising alternative fuels because it is abundant and extremely clean burning. According to the U.S. Department of Energy, exhaust emissions from natural gas vehicles (NGVs) are much lower than those of gasoline-powered vehicles. For instance, carbon monoxide (CO) and nitrogen oxides ($NO_x$) are reduced by more than 90 and 60 percent, respectively, and carbon dioxide ($CO_2$), a greenhouse gas, is reduced by 30 to 40 percent. When used in medium- and heavy-duty engines, CO and particulate matter (PM) reductions of over 90 percent, and $NO_x$ reductions of over 50 percent, have been demonstrated compared to diesel engines. However, one of the reasons that NGVs have not been as widely accepted as gasoline-powered vehicles is the lack of an extensive public refueling infrastructure.

Natural gas is typically stored aboard a vehicle either as a gas (e.g., compressed natural gas) or as a liquid (e.g., liquefied natural gas (LNG)). When natural gas is stored as a gas, it can be in the form of a compressed natural gas (CNG) or an adsorbed natural gas (ANG). CNG typically refers to natural gas stored in a tank without any adsorbent and compressed to a relatively high pressure (such as about 20 MPa (i.e., about 200 bars) or higher). ANG typically refers to natural gas stored in a tank containing a natural gas adsorption material and compressed to a relatively low pressure (such as about 3.5 MPa (i.e., about 500 psi) or lower).

SUMMARY

This disclosure is based on the unexpected discovery that an ANG natural gas storage tank that includes at least one porous, flexible container (e.g., a pouch or a sack made from a fabric material) having a suitable pore size and containing a natural gas adsorption material (e.g., activated carbon) can effectively prevent the powder generated from the natural gas adsorption material from leaking out of the tank and clogging the other parts (e.g., a pipe, a valve, or an engine) of a system connecting to the tank and utilizing the natural gas. Such an ANG natural gas storage tank can significantly extend the use life of a system powered by natural gas. In addition, because such an ANG storage tank stores natural gas at a relatively low pressure, it can be used in natural gas powered vehicles that can be refueled at a consumer's home, thereby allowing a much wider acceptance of such vehicles by consumers.

In one aspect, the disclosure features a natural gas adsorption device that includes (1) at least one porous, flexible container containing at least one porous layer, the porous layer having an average pore diameter and is permeable to natural gas, (2) a natural gas adsorption material at least partially disposed in the container, the material having a volume average diameter larger than the average pore diameter of the container, and (3) a storage tank having an opening, the tank enclosing the container and the natural gas adsorption material.

In another aspect, the disclosure features a vehicle containing an engine and a natural gas adsorption device described above.

In still another aspect, the disclosure features a method for storing natural gas. The method includes transferring natural gas into the natural gas adsorption device described above through a natural gas-tight compressor that can be pressurized to at most about 80 bars (e.g., at most about 50 bars).

In yet another aspect, the disclosure features a natural gas adsorption device that includes a storage tank having an opening, a first filter in the tank covering the opening, and a second filter in the tank covering the opening. The first filter is made from a porous material selected from the group consisting of porous metal, glass wool, frit glass, and zeolite pellets. The second filter is made from a porous, flexible material. The first filter is between the second filter and the opening.

Embodiments can include one or more of the following features.

In some embodiments, the container includes a material (e.g., a semi-crystalline polymer) having a melting temperature of at least about 85° C. or a material (e.g., an amorphous polymer) having a glass transition temperature of at least about 85° C.

In some embodiments, the container includes a material selected from the group consisting of glass, polyesters, polyacrylates, polymethacrylates, epoxy polymers, polyimides, polyvinyl alcohols, polyurethanes, polyacrylnitriles, polyolefins, polyphenylene sulfides, nylons, celluloses, polycarbonates, polyvinylidene fluorides, perfluoroalkoxy polymers, fluorinated ethylene-propylene polymers, polytetrafluoroethylenes, polyamides, and copolymers thereof.

In some embodiments, the container includes a fibrous material selected from the group consisting of glass fibers, alumina fibers, zirconia fibers, carbon fibers (e.g., carbon nanotube fibers), mineral fibers, metallic fibers, plant fibers, animal fibers, polyester fibers, polyolefin fibers, polyamide fibers (e.g., aromatic polyamide fibers), polyimide fibers, polyvinyl alcohol fibers, polyurethane fibers, polyamide fibers, polyphenylene sulfide fibers, aramid fibers, nomex fibers, polyvinylidene difluorene fibers, polytetrafluoroethylene fibers, cellulous fibers, and combinations thereof. An example of plant fiber is cotton and an example of animal fiber is silk.

In some embodiments, the container includes two or more porous layers.

In some embodiments, the device includes two or more porous, flexible containers, at least one of which envelops the opening of the tank and does not contain the natural gas adsorption material.

In some embodiments, the container is formed on a surface of the natural gas adsorption material by a coating process.

In some embodiments, the container is formed on an inner surface of the tank.

In some embodiments, the device further includes a plurality of spacers located in the container or between the container and the tank. In some embodiments, each spacer has the shape of a tube, a hollow sheet, or a sheet containing grooves.

In some embodiments, wherein each spacer is made from a thermally conductive material, which can include a metal, a metal polymer composite, a metal coated plastic material, or a thermally conductive ceramic.

In some embodiments, the device further includes a thermally conductive material located in the container or between the container and the tank. For example, the thermally conductive material can include a metal-containing fiber, a metal-containing coating, a metal-containing film, or a solid-state carbonaceous material.

In some embodiments, the natural gas adsorption material has a volume average diameter between about 0.001 mm to about 20 mm.

In some embodiments, the natural gas adsorption material can include a material selected from the group consisting of activated carbon, carbon black, zeolites, activated graphite, carbon molecular sieve, activated charcoal, and mixtures thereof.

In some embodiments, the natural gas adsorption material is activated with a plasma discharge generated by electrical voltage.

In some embodiments, the natural gas adsorption material is activated by plasma initiated by a glow discharge (e.g., generated by capacitive or inductive coupling from a plasma power source).

In some embodiments, the opening allows the container containing the natural gas adsorption material to be placed into or removed from the tank.

In some embodiments, the container has an opening that allows the natural gas adsorption material to be placed into or removed from the tank.

In some embodiments, the device is capable of storing natural gas at a pressure of at most about 80 bars (e.g., at most about 50 bars).

In some embodiments, the vehicle further includes a fuel purifier that is upstream from the natural gas adsorption device and removes heavy hydrocarbons, sulfur-containing compounds or water from a natural gas stream.

In some embodiments, the fuel purifier includes an absorbent containing activated carbon, activated charcoal, or zeolite.

In some embodiments, the fuel purifier uses engine exhaust heat to reactivate the absorbent in-situ.

In some embodiments, the vehicle has dual NG refueling ports such that the vehicle is capable of being refueled by either a high pressure compressor that can be pressurized up to 200 bars or a low pressure compressor that can be pressurized up to 80 bars.

In some embodiments, the vehicle is powered by natural gas alone. In some embodiments, the vehicle is powered by a mixture of natural gas and a liquid fuel, the liquid fuel comprising gasoline, diesel, an alcohol, or a mixture thereof.

In some embodiments, the vehicle is capable of switching between the natural gas and the liquid fuel while the engine is running.

In some embodiments, the vehicle is capable of driving at least 100 kilometers on the liquid fuel and is capable of driving at least 30 kilometers on natural gas before refueling.

In some embodiments, the vehicle further includes an induction heating apparatus surrounding the natural gas adsorption device, the apparatus being capable of heating the natural gas adsorption device to speed up release of natural gas. In some embodiments, the vehicle further includes a natural gas pressure regulator capable of adjusting the pressure of natural gas before the natural gas is injected into the engine.

In some embodiments, the vehicle is a motorcycle, a passenger vehicle (e.g., a sedan), a truck, or a boat.

In some embodiments, the compressor can include at least a crankshaft and at least a piston driven by the crankshaft.

In some embodiments, the compressor has at least a crankshaft gas seal on a crankcase to prevent natural gas from leaking out of the compressor.

In some embodiments, the compressor is enclosed in a gas-tight pressure vessel to prevent natural gas from leaking out of the pressure vessel.

In some embodiments, the compressor is substantially free of an oil or a lubricant.

In some embodiments, the compressor is a rotary compressor or an axial piston compressor.

In some embodiments, the method further includes supplying natural gas to the compressor from a natural gas source having a pressure of at most about 80 bars (e.g., at most about 50 bars).

In some embodiments, the method further includes activating the natural gas adsorption material by vacuum while the material is in the storage tank.

In some embodiments, the method further includes activating the natural gas adsorption material by heating the material to at least about 40° C. while the material is in the storage tank.

BRIEF DESCRIPTION OF DRAWINGS

FIG. 4 illustrates an exemplary device for activating a natural gas adsorption material by using a plasma discharge.

FIG. 5*a* illustrates an exemplary natural gas adsorption device that includes an ANG storage tank having a porous metal filter installed at the tank opening.

FIG. 5*b* illustrates an exemplary natural gas adsorption device that includes an ANG storage tank having two filters installed at the tank opening, one being a porous metal filter and the other being a porous, flexible fabric filter.

DETAILED DESCRIPTION

In some embodiments, this disclosure features a natural gas adsorption device that includes a storage tank. The storage tank includes at least one porous, substantially flexible container (e.g., a pouch) that is permeable to natural gas. The tank can further include a natural gas adsorption material at least partially (e.g., fully) disposed in the container. As used herein, the term "natural gas" refers to a methane rich gas obtained from any suitable source, such as pure methane or methane-rich gases obtained from a landfill, a coal layer, or an oil or gas field.

Figure 1A:
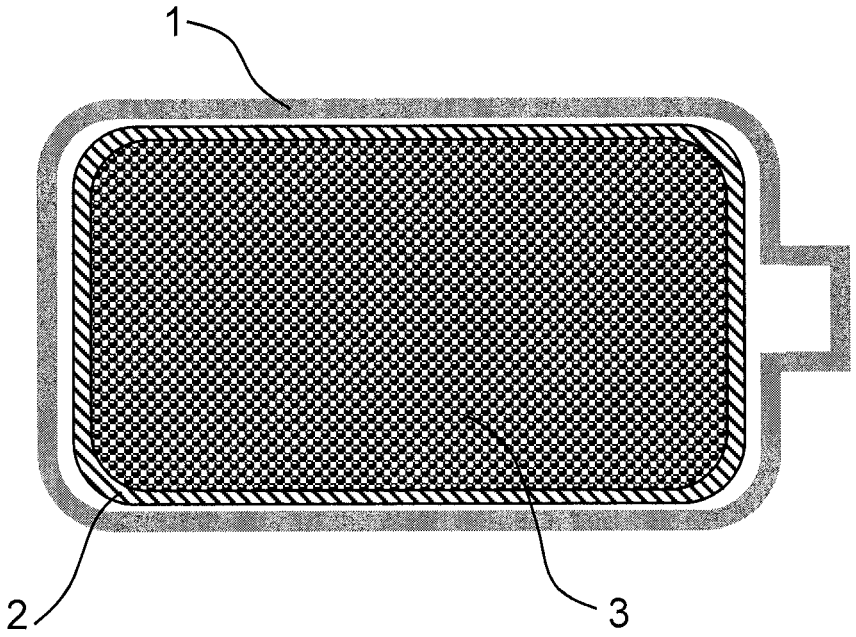
FIG. 1*a* is a cross-sectional view of an exemplary natural gas adsorption device that includes a natural gas adsorption material, a pouch containing the natural gas adsorption material, and a storage tank containing the pouch.

FIG. 1*a* is a cross-sectional view of an exemplary natural gas adsorption device that includes a storage tank 1. Storage tank 1 includes a porous, flexible container 2 (e.g., a pouch) that contains a natural gas adsorption material 3. In general, storage tank 1 has an opening that allows container 2 to be placed into or removed from the tank. There may or may not be a substantial gap between the outer surface of container 2 and the inner surface of storage tank 1.

In some embodiments, container 2 can be made from a pliable or flexible fabric material. The fabric material can be either non-woven or woven. A non-woven fabric is generally a sheet or a web structure bonded together by entangling fibers or filaments mechanically, thermally, or chemically. It is typically a flat, porous sheet that is made directly from individual fibers, molten plastic, or plastic film. It can be formed by a single type of fiber or a combination of different fibers. The fiber diameter can range from 5 nm to 500 microns. The non-woven fabric can contain a densified structure or reinforced by a backing to increase its strength. The non-woven fabric can be made from a staple nonwoven material, a spunbond nonwoven material, or an air-laid paper. An example of a non-woven fabric is a spunbond-meltblown-spunbond nonwoven fabric made from polypropylene. A commercially available fabric is a porous, dust preventing cleanroom garment fabric, which is often made of PET, PTFE, or polypropylene. A woven fabric is generally formed by weaving, knitting or braiding different sets of yarns and threads in an interlaced or interlocked fashion.

In some embodiments, container 2 can be made from a film with pores (e.g., micropores) that allow natural gas to pass through while blocking particles of adsorption material 3 from passing through. Examples of such films include expanded plastic films. Expanded plastic films generally are plastic films being stretched or processed to have porous structures that allow a gas (e.g., natural gas) to pass through. Examples of suitable expanded plastic films include those formed from expanded Teflon or expanded polypropylene. A commercially available expanded film is a GORE-TEX membrane (which is an expanded PTFE membrane) available from W. L. Gore & Associates, Inc. (Elkton, Md.). Such a microporous membrane can be sandwiched between protective layers having a pore size similar to or larger than the expanded PTFE membrane.

In some embodiments, container 2 can be made from a material including a polymer selected from the group consisting of polyesters (e.g., polyethylene terephthalates), polyacrylates, polymethacrylates, epoxy polymers, polyimides, polyvinyl alcohols, polyurethanes, polyacrylnitriles, polyolefins (e.g., polypropylenes), polyphenylene sulfides, nylons, celluloses, polycarbonates, polyvinylidene fluorides, perfluoroalkoxy polymers, fluorinated ethylene-propylene polymers, polytetrafluoroethylenes, polyamides, and copolymers thereof. In some embodiments, container 2 can be made from a material including a polymer (e.g., an amorphous polymer) having a glass transition temperature of at least about 85° C. (e.g., at least about 100° C. or at least about 125° C.) or a polymer (e.g., a semi-crystalline polymer) having a melting temperature of at least about 85° C. (e.g., at least about 100° C. or at least about 125° C.).

In some embodiments, container 2 can be made from a fibrous material (e.g., organic or inorganic fibrous materials) selected from the group consisting of glass fibers (e.g., woven or non-woven glass fibers), alumina fibers, zirconia fibers, carbon fibers, mineral fibers, metallic fibers, plant fibers, animal fibers, polyester fibers, polyolefin fibers, polyamide fibers (e.g., aromatic polyamide fibers), polyimide fibers, polyvinyl alcohol fibers, polyurethane fibers, polyamide fibers, polyphenylene sulfide fibers, aramid fibers, nomex fibers, polyvinylidene difluorene fibers, polytetrafluoroethylene fibers, cellulous fibers, and combinations thereof. Without wishing to be bound by theory, it is believed that inorganic fibrous materials can offer excellent high temperature resistance and is of particular advantage for in-situ activation of natural gas adsorption material 3.

In some embodiments, the fibrous material can be made from microfibers or nanofibers. As used herein, "microfibers" refer to fibers having an average diameter of less than 100 microns but larger than 1 micron, and "nanofibers" refer to fibers having an average diameters less than 1 micron but larger than 1 nanometer.

In some embodiments, container 2 can be in form of a paper or a membrane. In some embodiments, container 2 can be made from a pulp or paper making process, which typical includes subjecting suspended cellulose fiber (or other organic or inorganic fibers) to a flocculation or filtration process (in which the concentration of the cellulose fiber is generally increased) and a subsequent pressing or dewatering process to remove the excess solvent (e.g., water). An exemplary container made by this approach is a paper filtering bag, which can be used to contain natural gas adsorption material 3.

In some embodiments, container 2 can be a microporous membrane made by precipitation from a solvent. For example, a microporous membrane can be made from casting a film from a polymer solution in a solvent (in which the polymer is highly soluble) onto a substrate, followed by introducing another solvent that causes part of the polymer to precipitate out of the solution, resulting in a microporous membrane. Other methods of introducing porosity into a polymer film as known by those skilled in the art can also be used to produce container 2.

In some embodiments, container 2 can include one porous layer. In other embodiments, container 2 can include two or more (e.g., three, four, or five) porous layers. In some embodiments, container 2 can include one or more (e.g., two, three, or four) porous abrasion resistant outer layers, one or more (e.g., two, three, or four) porous intermediate inner layers, and at least one layer of microporous membrane or microporous woven or nonwoven fabric.

In general, container 2 has pores large enough to allow natural gas to pass through. In some embodiments, container 2 has at least one porous layer that has an average pore diameter smaller than the volume average diameter of the natural gas adsorption material 3 to prevent the natural gas adsorption material 3 from leaking out of container 2. When container 2 has two or more porous layers, the additional porous layers can have an average pore diameter either smaller than or greater than the volume average diameter of the natural gas adsorption material 3. In general, container 2 is permeable to natural gas, while substantially blocking particles of the natural gas adsorption material 3 or any dust particles that the natural gas adsorption material 3 generates during its usage (e.g., from mechanical tearing and wearing of the natural gas adsorption material 3 during charge/discharge cycling). In some embodiments, a porous layer in container 2 can have an average pore diameter of at least about 0.5 nm (e.g., at least about 1 nm or at least about 2 nm) and/or at most about 100 μm (e.g., at most about 10 μm or at most about 1 μm). Without wishing to be bound by theory, it is believed that one advantage of container 2 is that it can function as a high performance filter that that prevents small dusts or particles generated from natural gas adsorption material 3 from leaking out of storage tank 1 and clogging the other parts (e.g., a pipe, a valve, or an engine) of a system connecting to the tank and utilizing the natural gas. Such a natural gas adsorption device can significantly extend the use life of a system powered by natural gas. In addition, because such a device stores natural gas at a relatively low pressure, it can be used in natural gas powered vehicles that can be refueled at a consumer's home, thereby allowing a much wider acceptance of such vehicles by consumers.

Without wishing to be bound by theory, it is believed that another advantage of using at least one container 2 to enclose a natural gas adsorption material 3 in storage tank 1 is that the container can significantly reduce the wear and tear to the natural gas adsorption material 3, thereby substantially minimizing the generation of particles or dust from natural gas adsorption material 3 during use and significantly increasing the life of storage tank 1, as well as the life of any system powered by storage tank 1.

In some embodiments, container 2 can have an opening (e.g., sealable opening) that allows natural gas adsorption material 3 to be placed into or removed from storage tank 1. As a result, natural gas adsorption material 3 can be removed from storage tank 1 and re-activated. In some embodiments, container 2 does not have an opening. In such embodiments, after being placed in storage tank 1, container 2 can be cut open to facilitate removal of natural gas adsorption material 3 from storage tank 1 or can be taken out of the tank without being cut open when the opening of storage tank 1 is sufficiently large.

In general, natural gas adsorption material 3 is a material that has a relatively large surface area and can attach natural gas to its surface through either adsorption or absorption. The terms "natural gas adsorption" and "natural gas absorption" are used herein interchangeably to denote the process in which natural gas is attached to the adsorption material 3 (e.g., via hydrogen bonding, dipole interaction, induced dipole interaction, ionic bonding, chemical bonding, or van der Waals force). Examples of suitable natural gas adsorption materials include activated carbon, carbon black, zeolites, activated graphite, carbon molecular sieve, activated charcoal, or mixtures thereof. Natural gas adsorption material 3 can be in any suitable form, such as powder, particles, or pellets.

In some embodiments, natural gas adsorption material 3 can be shaped as a briquette. It can be briquette shaped to begin with, or can be formed into briquettes from powder or pellet shaped materials by pressure or by using a binder resin. In such embodiments, even when natural gas adsorption material 3 is bound with binder or starting from a briquette shape, it usually has a small basic structure that is micron or nanometer in size. As a result, particles can easily be generated from the briquette (e.g., by mechanical tearing). These particles can get into components (e.g., the piping system, valves, and engines (if used in a vehicle)) connected to the natural gas adsorption device described herein for delivering natural gas to block these components. Without wishing to be bound by theory, the natural gas adsorption device described herein can effectively prevent such particles from leaking out of the storage tank and blocking the components mentioned above.

In some embodiments, natural gas adsorption material 3 can have a volume average diameter larger than the average pore diameter of container 2 to prevent it from leaking out of container 2. For example, natural gas adsorption material 3 can have a volume average diameter of at least about 0.001 mm (e.g., at least about 0.005 mm, at least about 0.01 mm, at least about 0.05 mm, or at least about 0.1 mm) and/or at most about 20 mm (e.g., at most about 15 mm, at most about 10 mm, at most about 5 mm, or at most about 1 mm). The volume average diameter mentioned herein refers to the average diameter of the constituent particles. For example, one can use pressure to compact a powdery form of activated carbon having a volume average diameter of 20 microns into monolith particles of more than 20 mm in size. In this example, the volume average diameter of the compacted adsorbent particles is still considered 20 microns.

In some embodiments, natural gas adsorption material 3 can be activated by a plasma discharge. The plasma discharge can be generated by any suitable method, such as electrical voltage. For example, a plasma discharge can be initiated by glow discharge, such as that generated by capacitive or inductive coupling from a plasma power source.

In general, storage tank 1 can be formed from any suitable material that can maintain a pressure of at least about 80 bars. In some embodiments, storage tank 1 can be formed from a metal, a polymer, or a composite material.

Storage tank 1 generally has an opening that allows container 2 and natural gas adsorption material 3 to be placed into or removed from storage tank 1. The opening can have a size either larger or smaller than container 2 that is filled with natural gas adsorption material 3.

In some embodiments, storage tank 1 can be assembled by any suitable methods. For example, storage tank 1 can be assembled as follows: Container 2 (e.g., a pouch or a sack made from a polymeric non-woven material) can first be partially inserted into storage tank 1 with its opening still outside of the opening of storage tank 1. The natural gas adsorption material 3 (e.g., in the shape of a powder or pellet) can be added into container 2 (e.g., through a funnel or a tube) by passing through the tank opening. After addition of natural gas adsorption material 3 is completed, the opening of container 2 can be sealed. The sealing can be performed though heating (e.g., using thermal fusing), tying (e.g., using a plastic or wire tie), sewing, gluing, resin bonding (e.g., using an adhesive), or other mechanical or chemical methods. The entire container 2 can then be inserted into storage tank 1. In some embodiments, a string or a hook can be attached to container 2 to facilitate retrieval of container 2 for replacement of the natural gas adsorption material 3. In some embodiments, natural gas adsorption material 3 can be added into container 2 by placing container 2 in storage tank 1 in its entirety, inserting a tube in container 2 through its opening and the opening of storage tank 1, and then adding natural gas adsorption material 3 into container 2 through the tube.

Figure 1B:
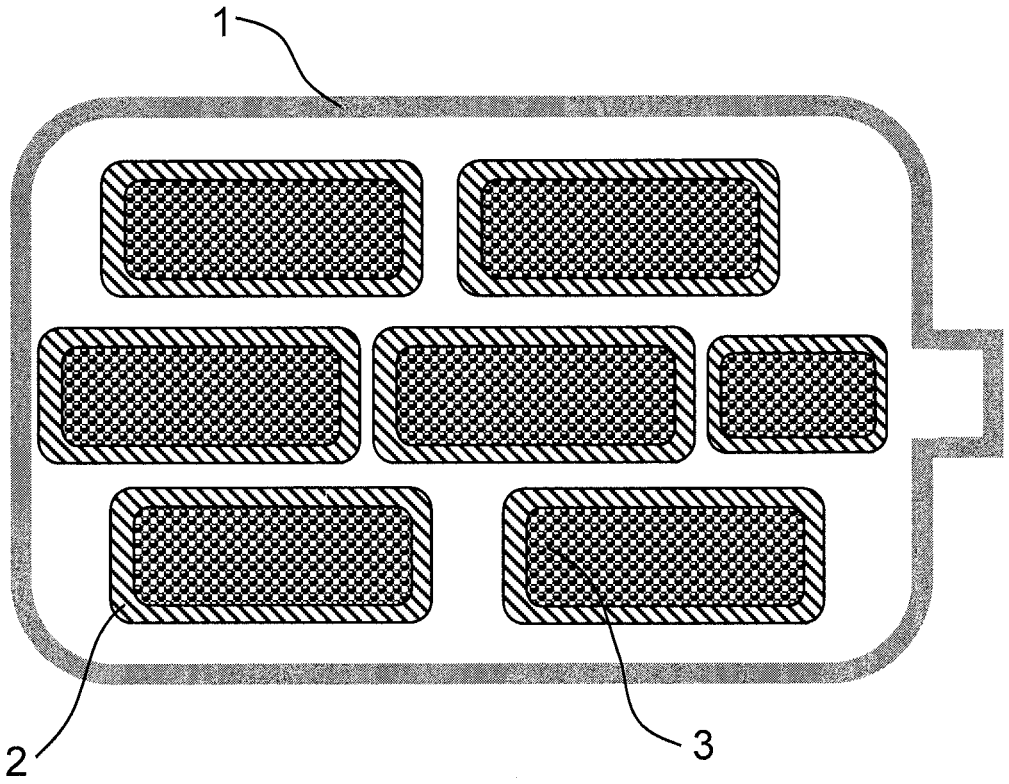
FIG. 1*b* is a cross-sectional view of an exemplary natural gas adsorption device that includes a plurality of pouches, each of which contains a natural gas adsorption material, and a storage tank containing the pouches.

In some embodiments, storage tank 1 can include two or more porous, flexible containers. For example, FIG. 1*b* shows an exemplary natural gas adsorption device that includes a storage tank 1 containing a plurality of porous, flexible containers 2, each of which contains a portion of natural gas adsorption material 3. In some embodiments, at least some (e.g., all) of containers 2 are separated from the other containers and can simply be piled together with the other containers in the tank. In some embodiments, at least some (e.g., all) of containers 2 are physically attached to each other. In such embodiments, the attached containers 2 can be easily removed from the tank from its opening by pulling one of the containers out of the tank. In some embodiments, the plurality of containers 2 can have the same size or can have different sizes.

In some embodiments, container 2 can be formed on the surface of pre-formed compacted natural gas adsorption material 3, e.g., by a coating process. For example, the powdery or granular natural gas adsorption material 3 can be first compacted by pressure into a shape (e.g., a briquette or cylindrical shape), and an outer layer (e.g., a polymer polymer) is then coated onto the compacted material to form container 2. Examples of suitable coating processes include dip coating, electrophoresis coating, powder coating, and spray coating. Typically, a foaming process (by using foaming agents or blow agents) is introduced during or after the coating is cured to form a porous outer layer. For example, if a polyurethane is used as the coating material, water can be introduced as a foaming agent to produce a porous foamed polyurethane coating. In some embodiments, the pores thus formed are substantially connected and permeable to natural gas, but substantially impermeable to powders or dusts generated from natural gas adsorption material 3.

In some embodiments, container 2 can be formed along the interior wall of storage tank 1. For example, container 2 can be a single- or multiple-layer porous liner covering the interior wall of the tank. In such embodiments, natural gas adsorption material 3 can be filled in container 2 after it is formed on the interior wall of tank 1 (e.g., by a polymer melt blowing process). The opening of container 2 can then be sealed to envelop natural gas adsorption material 3 completely. In some embodiments, a foaming process can be introduced during or after the liner is formed. For example, when a polyurethane is used to form container 2, a polyurethane coating containing a blowing agent or a foaming agent (e.g., water) can first be applied to the interior wall of storage tank 1 (e.g., up to the neck of the tank opening). The liner can then be made porous by a foaming process to form container 2. After natural gas adsorption material 3 is added into container 2, the opening of container 2 can then be closed by forming a porous polyurethane coating (e.g., using a foaming process such as that described above) at the opening.

In general, a coating formed by the foaming process described above can have open pore structures that are formed by incorporating soluble micron-sized particles into the coating layer, which can be removed during the foaming process or by other methods as known by those skilled in the art of foaming.

Figure 2:
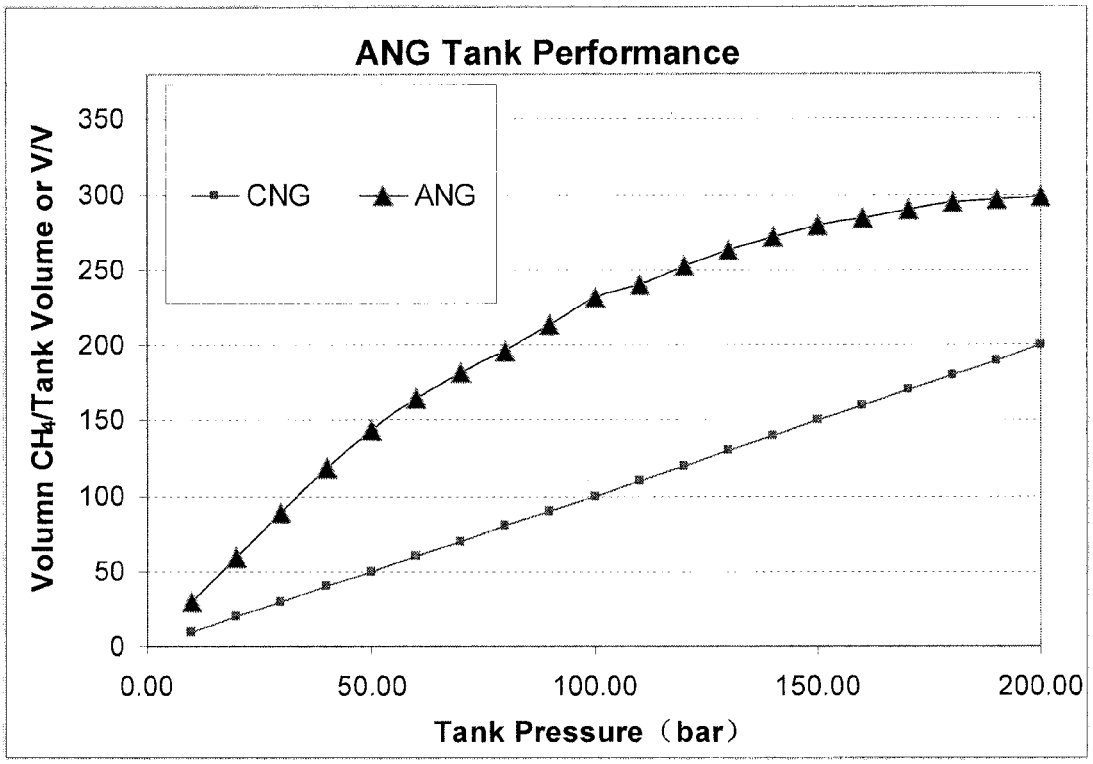
FIG. 2 is a graph showing an exemplary comparison between the storage capacity of an ANG storage tank containing activated carbon and that of a CNG storage tank.

FIG. 2 is a graph showing an exemplary comparison between the storage capacity of an ANG storage tank containing activated carbon and that of a CNG storage tank. As shown in FIG. 2, the ANG storage tank can contain up to 3 times as much as natural gas as the CNG storage tank when both tanks have a pressure of 50 bars or less. The data in FIG. 2 are obtained from the inventors' laboratory test with ANG tanks having container 2 described herein.

Figure 3:
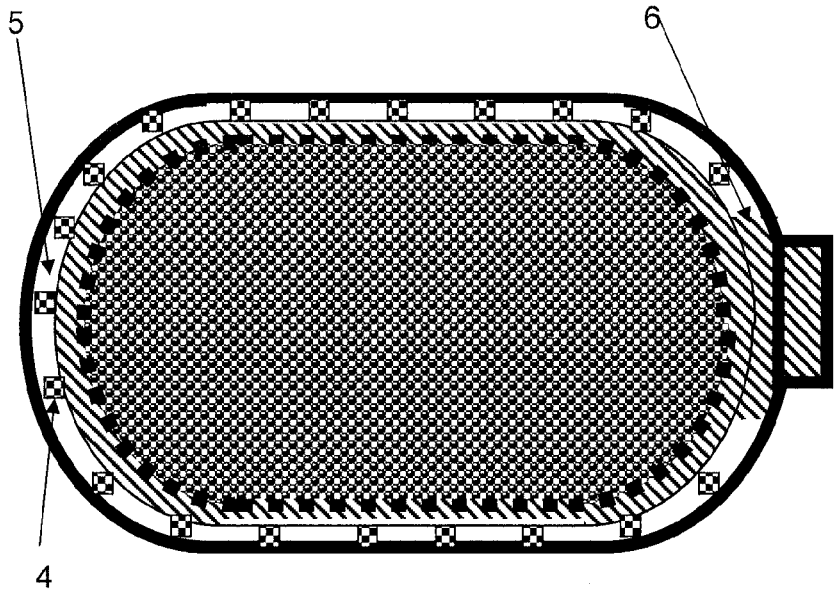
FIG. 3 is a cross-sectional view of an exemplary natural gas adsorption device that includes a storage tank containing a plurality of spacers, which form air flow channels to facilitate gas flow over the entire volume of the tank.

In some embodiments, storage tank 1 can include one or more spacers to facilitate natural gas flow inside the tank. FIG. 3 is a cross-sectional view of an exemplary storage tank including a plurality of spacers 4. As shown in FIG. 3, spacers 4 are located between the outer surface of a porous, flexible container containing a natural gas adsorption material and the inner surface of a storage tank, and form gas flow channels 5 to facilitate natural gas flow over the entire volume of the tank. In some embodiments, at least some (e.g., all) of spacers 4 can be located inside the porous, flexible container to form gas flow channels 5 therein. Without wishing to be bound by theory, it is believed that spacers 4 can facilitate a uniform adsorption/desorption throughout the entire storage tank.

In general, spacers 4 can have any suitable shapes. In some embodiments, spacers 4 can be in the shape of a tube, a hollow sheet (e.g., a sheet containing hollow channels), or a sheet containing grooves. In some embodiments, spacers 4 can be tubes having holes on the tube surface. In some embodiments, when spacers 4 are in the shape of a hollow sheet, they can include hollow channels sandwiched between two sheet layers, which can facilitate natural gas flow in the storage tank. In some embodiments, spacers 4 can be branched hollow tubes, in which tubes having a larger diameter branches out into tubes having a smaller diameter. In such embodiments, walls of these tubes can have perforations. In some embodiments, spacers 4 can be obtrusions that are built on the tank inner surface or attached to the tank lining. In some embodiments, spacers 4 can be uneven structures (e.g., obtrusions or indentations) built on the tank inner surface or on the fabric used to form the porous, flexible container.

In some embodiments, spacers 4 can be disposed in a storage tank containing two or more (e.g., any number from three to ten) porous, flexible containers to facilitate natural gas flow inside the storage tank. In such embodiments, spacers 4 can be disposed between a porous, flexible container and the inner surface of the storage tank or between two or more of the porous, flexible containers.

In general, spacers 4 can be made from any suitable materials. In some embodiments, spacers 4 can be made from a thermally insulating material. Examples of suitable thermally insulating materials include polymers and ceramics. In some embodiments, spacers 4 can be made from a thermally conductive material (e.g., a material having a thermal conductivity higher than that of natural gas adsorption material). For example, spacers 4 can have thermal conductivity of at least 200 W/m·K). Examples of suitable thermally conductive materials include metals (e.g., aluminum), metal polymer composites, metal coated plastic materials, or thermally conductive ceramics. In addition to facilitating natural gas flow in the storage tank, spacers 4 made from a thermally conductive material can facilitation even distribution of heat generated from absorption/desorption process.

FIG. 3 is a cross-sectional view of an exemplary natural gas adsorption device that includes a storage tank containing a plurality of spacers, which form air flow channels to facilitate gas flow over the entire volume of the tank. As shown in FIG. 3, the storage tank can include an optional filter 6 inside the tank that envelops the tank opening to further prevent particles generated from natural gas adsorption material 3 from leaking out of the storage tank and getting into other parts (e.g., pipes or valves) that are connected to the tank. In some embodiments, filter 6 can be made from the same materials described above with respect to the porous, flexible container. In general, filter 6 can be permanently attached the storage tank or can be replaceable.

In general, during the adsorption/desorption of natural gas, heat is generated or absorbed by the natural gas adsorption material. In some embodiments, the storage tank can further include a thermally conductive material in addition to spacers 4 described above to improve heat conduction. Examples of suitable thermally conductive materials include metals, metal polymer composites, metal coated plastic materials, or thermally conductive ceramics. In some embodiments, the thermally conductive material can be incorporated into the material (e.g., a fabric material) used to form the porous, flexible container. For example, the thermally conductive material can be in the form of metal fibers, which can be incorporated into the fabric material used to form the porous, flexible container. As another example, the thermally conductive material can be in the form of metal films, which can be attached to the fabric material used to form the porous, flexible container by a suitable coating method (e.g., solution coating, plate coating, or vapor coating). As another example, the thermally conductive material can be in the form of metal particles, metal wires, metal strips, or metal sheets, which can be embedded in the natural gas adsorption material to facilitate heat transfer.

In some embodiments, a substance of high heat conduction can be used as a thermally conductive material to reduce the temperature swing in the adsorption/desorption process to improve the natural gas adsorption/desorption rate and to reduce natural gas charge/discharge time. Examples of such substances include carbonaceous substances, such as carbon black (e.g., formed by acetylene pyrolysis). For example, carbon black formed by acetylene pyrolysis can be mixed with activated carbon. The mixture thus formed can then be pelletized to form a natural gas adsorption material. Alternatively, carbon black formed by acetylene pyrolysis can be coated onto the surface of pelletized activated carbon to form a natural gas adsorption material.

In some embodiments, the natural gas adsorption material described herein can be heated to facilitate release of adsorbed natural gas. In general, desorption of natural gas absorbs heat from environment and therefore results in a decrease of the temperature of the natural gas adsorption material. This decrease in temperature can make desorption of natural gas more difficult. Thus, heating the natural gas adsorption material can assist the releasing of adsorbed natural gas. In some embodiments, the natural gas adsorption material can be heated by using an electrical heating unit, such as a heating rod, heating wire, or heating tape. The electrical heating unit can be integrated with the material (e.g., a fabric material) used to form the porous, flexible container (e.g., a pouch), spacers 4, or the thermally conductive material described above. For example, the electrical heating unit can be attached to the surface of the fabric used to form a pouch, placed between two pouches, between a pouch and the tank inner surface, or in the natural gas adsorption material in a pouch. In such embodiments, the electrical heating unit can have connectors electrically connected with an external electrical source. In some embodiments, a temperature sensor can be placed in the storage tank to monitor the temperature and to provide control signals for the electrical heating unit.

In some embodiments, the natural gas adsorption material described herein can be cooled to facilitate adsorption of natural gas. In general, adsorption of natural gas can generate a large amount of heat, which can increase the temperature of the adsorption material and negatively affect the natural gas adsorption process. Thus, in some embodiments, a cooling device can be added to the storage tank to improve adsorption of natural gas. For example, a cooling device (e.g., a heat sink) can be disposed inside the storage tank or attached to the outer surface of the storage tank. In some embodiments, a temperature sensor can be placed in the storage tank to monitor the temperature and to provide control signals for the cooling device.

During use, the natural gas adsorption material can be poisoned by adsorbing a certain detrimental gas (such as carbon monoxide or hydrogen sulfide) existing in natural gas. As a result, the natural gas adsorption material can lose its adsorption activity. The poisoned natural gas adsorption material can be re-activated by subjecting the poisoned material to vacuum and/or heating to at least about 40° C. (and/or at most about 200° C.), without removing the natural gas adsorption material from the flexible, porous container or removing the flexible, porous container from the storage tank. In some embodiments, the re-activation can be aided by heating (e.g., using the electrical heating unit described above). Without wishing to be bound by theory, it is believed that one advantage of the storage tank described herein is that it can be used to easily re-activate the natural gas adsorption material without complex operations (e.g., removing the natural gas adsorption material from the tank).

The present disclosure also features a method of activating the natural gas adsorption material. The method includes treating the natural gas adsorption material with a plasma discharge. The plasma discharge can be generated by any suitable method, such as applying an electrical voltage. For example, a plasma discharge can be initiated by a glow discharge by applying an electric voltage through a gas. Examples of suitable gases for generating glow discharge include oxygen, methane, air, water vapor, inert gases, ammonia, and a mixture thereof. Conventionally, a natural gas adsorption material is prepared by a thermo-chemical activation process, which requires large energy consumption. Unexpectedly, activating the natural gas adsorption material by treating it with a plasma discharge can significantly improve the performance (e.g., adsorption capacity) of the adsorption material, reduce energy consumption, and minimize costs. For example, activated carbon treated by oxygen plasma can have up to 35% increase in its adsorption capacity.

FIG. 4 illustrates an exemplary device for activating a natural gas adsorption material by using a plasma discharge. As shown in FIG. 4, the device includes a pair of electrodes 11 (e.g., metal electrodes), each of which is coated with an insulator layer 12. The upper electrode is electrically connected to a high voltage power source 13, and the lower electrode is electrically connected to ground 14. A gas (not shown in FIG. 4) is filled between electrodes 11. A natural gas adsorption material 10 in the form of pellets can be activated by an electron-ion plasma, which can be generated by applying a higher voltage (e.g., at least 4000V) to electrodes 11 for a suitable period of time (e.g., an hour).

In some embodiments, the natural gas adsorption device described herein can be used to store natural gas in a large scale. For example, the ANG storage tank in such a natural gas adsorption device can have a volume of at least about 10,000 cubic feet (e.g., at least 50,000 cubic feet, at least about 100,000 cubic feet, or at least about 500,000 cubic feet). In such embodiments, the natural gas adsorption device can be used to store and supply natural gas in a long distance natural gas pipeline or network.

In some embodiments, when the opening of an ANG storage tank is large enough, a filter (e.g., a porous, substantially rigid filter) can be installed at the opening inside the storage tank. Such a filter is typically made of a porous metallic material and can withstand a high temperature (e.g., at least 400° C.). FIGS. 5*a* and 5*b* show storage tanks having such a metal filter. Specifically, FIG. 5*a* illustrates an exemplary natural gas adsorption device that includes an ANG storage tank 21. ANG storage tank 21 contains a natural gas adsorption material 23, a gas inlet/outlet fitting 27, and a filter 26 (e.g., a porous, substantially rigid filter) attached to the tip of fitting 27. In some embodiments, the porous, substantially rigid filer is made from a porous metal, glass wool, frit glass, or zeolite pellets. As shown in FIG. 5*a*, natural gas adsorption material 23 is not disposed in any additional container (such as the porous, flexible container 2 described above). In some embodiments, natural gas adsorption material 23 can be disposed in the porous, flexible container 2 described above, which can serve as a filter to prevent natural gas adsorption material from leaking out of storage tank 21. FIG. 5*b* shows another exemplary natural gas adsorption device, which is similar to that described in FIG. 5*a* except that filter 26 is further covered by a second filter 22 (e.g., a porous, flexible filter) to prevent filter 26 from being clogged by the dust generated from natural gas adsorption material 23. In some embodiments, filter 22 can be made from the same materials as those described above with respect to the porous, flexible container 2. When filter 22 is made from a flexible material (e.g., a fabric material), it can deform each time the ANG tank is refilled, which helps to prevent the dust from accumulating and clogging the pores of filter 26. In some embodiments, when filter 22 is made of high temperature-resistant fibers (such as glass fiber, polyphenylene sulfide, or PTFE), ANG storage tank 21 can withstand a high temperature.

In some embodiments, the natural gas adsorption device described herein can be used by a consumer, for example, to power a vehicle (e.g., a two-wheeled or three-wheeled motorcycle, a passenger vehicle such as a sedan, a truck, or a boat). In such embodiments, the ANG storage tank in the natural gas adsorption device can store a larger amount of natural gas than a CNG storage tank at a relatively low pressure (e.g., at most about 80 bars, at most about 50 bars, at most about 25 bars, and at most about 2 bars). For example, the ANG storage tank described herein can store at least three times of natural gas than a CNG tank at a pressure of 50 bars or less. In such embodiments, the natural gas adsorption device described herein can have a relatively small volume such that it can be mounted on a vehicle. For example, the ANG storage tank in such a natural gas adsorption device can have a volume of at most about 200 liters (e.g., at most 100 liters, at most about 75 liters, or at most about 50 liters).

In some embodiments, a vehicle having the natural gas adsorption device described herein can be powered by natural gas alone. In some embodiments, a vehicle having the natural gas adsorption device described herein can be powered by a mixture of natural gas and a liquid fuel. The liquid fuel can include gasoline, diesel, an alcohol, or a mixture thereof. In such embodiments, the vehicle can be capable of switching between the natural gas and the liquid fuel while its engine is running. For example, the fuel switching can be commanded manually by a switch in the driver's console or automatically by the engine management system. When natural gas is used, the natural gas can be injected into the air stream through the vehicular air filter, with the liquid fuel injector disabled. The switch back to liquid fuel can be a reversed process.

In some embodiments, a vehicle having the natural gas adsorption device described herein can further include a natural gas pressure regulator capable of adjusting the pressure of the natural gas fuel before the gas is injected into the engine of the vehicle. In some embodiments, the pressure regulator can be heated by engine oil or automatic transmission fluid to prevent it from freezing or clogging due to icing resulted from the Joule-Thomson effect when the natural gas is depressurized.

In some embodiments, a vehicle having the natural gas adsorption device described herein can be powered by both natural gas and a battery. In such embodiments, the vehicle is capable of switching between the natural gas and the battery while the engine is running.

In some embodiments, the vehicle can be capable of driving at least 100 kilometers (e.g., at least about 150 kilometers, at least about 200 kilometers, or at least about 300 kilometers) on the liquid fuel and capable of driving at least 30 kilometers (e.g., at least about 50 kilometers, at least about 100 kilometers, or at least about 200 kilometers) on natural gas before refueling. In some embodiments, the vehicle can include an heating apparatus (e.g., an induction heating apparatus) surrounding the natural gas adsorption device, the apparatus being capable of heating the natural gas adsorption device to speed up release of natural gas.

Figure 6:
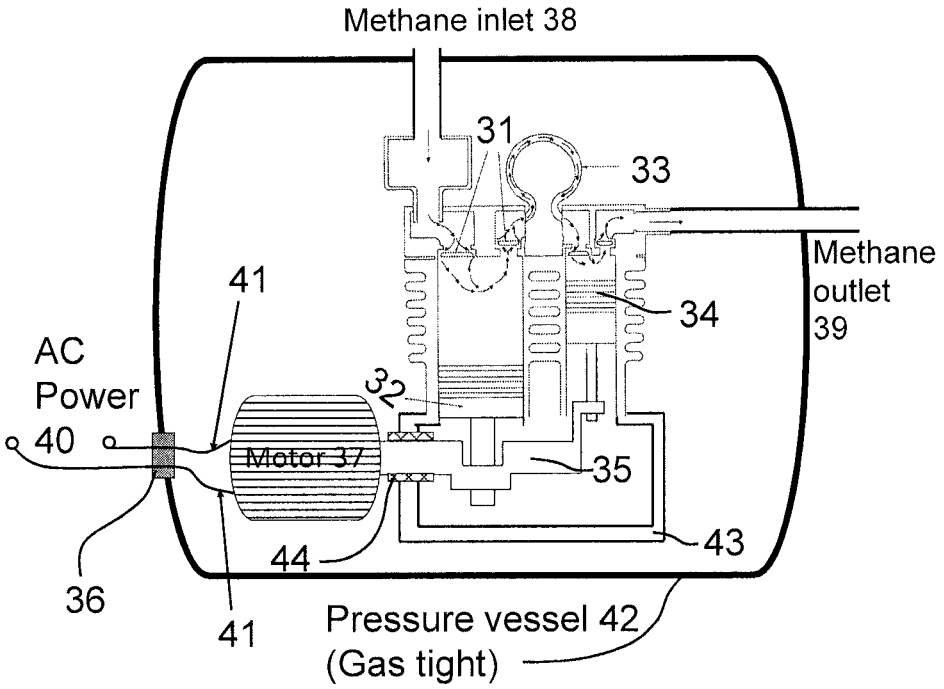
FIG. 6 illustrates an exemplary natural gas compressor having a two-stage reciprocal piston design.

The present disclosure also features a compressor (e.g., a leak-free, oil-free compressor) that can be used in combination with the natural gas adsorption device described herein. FIG. 6 shows an example of such a compressor. Specifically, FIG. 6 illustrates an exemplary natural gas compressor having a two-stage reciprocal piston design (i.e., a reciprocal compressor). A reciprocal compressor compresses a gas in the space confined by a compressor cylinder, a cylinder head, and a piston assembly. The compression is effected by the reciprocal motion of the piston assembly, with the help of a set of valves and gas passage. It typically has a crankcase through which a crankshaft (which drives pistons) is attached to via bearings. As shown in FIG. 6, the compressor has first stage valves 31, a first stage piston 32, an inter-stage cooler 33, a second stage piston 34, a crankshaft 35, an electric feedthrough 36, an electrical motor 37, a gas inlet 38, a gas outlet 39, a pair of electric wires 41, a pressure vessel 42 (which can be substantially leak proof), a crankcase 43, and an optional crankshaft gas seal 44. Electrical motor 37 can be electrically connected to an external AC power 40 by electric wires 41. Pistons 32 and 34 can be made from a metallic material, a non-metallic material, or a mixture thereof. Pressure vessel 42 can be substantially leak proof (i.e., gas tight) to prevent natural gas from leaking out of the compressor. In some embodiments, pressure vessel 42 is made of a metal or a metal alloy (e.g., steel). In general, pressure vessel 42 can withstand the pressure generated by compressing natural gas using the compressor. For example, if the compressor can compress natural gas to a pressure up to 50 bars, the pressure vessel can withstand at least the same pressure. Electric feedthrough 36 can maintain the structural integrity and the seal of pressure vessel 42 while allowing electricity to reach electric motor 37 from AC power 40.

During use, the compressor shown in FIG. 6 can operate as follows (using a 50-bar compression as an example): First, natural gas enters the compressor from gas inlet 38, whose flowing path is controlled by first stage valves 31. The natural gas can then be compressed by first stage piston 32 to a pressure of around 7 bars and pushed to inter-stage cooler 33. After being compressed for the second time by second stage piston 34, the natural gas can then leave the compressor through gas outlet 39. Before leaving the compressor, the natural gas can go through another cooler, also known as after-cooler (not shown in FIG. 6). The two pistons 32 and 34 can both be driven by a common crankshaft 35. The pressure of natural gas can go up to about 50 bars after the second stage.

In some embodiments, a two-stage compressor can be formed from a reciprocal compressor, a rotary compressor, an axial piston compressor, or a combination thereof. A rotary compressor compresses a gas through a rotary motion of moving parts in a compression cycle. The rotation of movable parts is often driven by a shaft that is connected to external prime mover. Examples of rotary compressors include roots compressors, vane compressors, screw compressors, scroll compressors, or gear compressors.

In some embodiments, the compressor can be free of an oil or a lubricant. An advantage of such a compressor is that it can reduce the chance of oil or oil vapor contaminating natural gas adsorption material 3 or the fuel purifier described herein.

In some embodiments, the compressor can include a crankshaft gas seal on a crankcase to prevent natural gas from leaking out of the compressor. For example, as shown in FIG. 6, crankcase 43 is a container that structurally supports crankshaft 35. A crankshaft gas seal 44 can be added onto crankcase 43 to prevent leakage of compressed natural gas from getting out of crankcase 43. In such embodiment, pressure vessel 41 shown in FIG. 6 can be omitted from the compressor.

In some embodiments, the compressor can transfer natural gas into the storage tank in the natural gas adsorption device at a relatively low pressure (e.g., at most about 80 bars, at most about 50 bars or at most about 25 bars). It is believed that widespread adoption of natural gas as a fuel for automobiles has been hampered by the lack of refueling infrastructure (e.g., commercial fueling stations). In other words, there are too few natural gas fueling stations in the world at the present time to support a significant large number of natural gas vehicle ownership. Without wishing to be bound by theory, it is believed that one advantage of the compressor described above is that it allows the natural gas adsorption device to be refueled at a consumer's home, thereby reducing the consumer's reliance on commercial natural gas fueling stations and allowing a wide adoption of natural gas as a fuel for automobiles.

In some embodiments, the natural gas adsorption device described herein can be used in a vehicle have dual NG refueling ports such that the vehicle is capable of being refueled by either a high pressure compressor that can be pressurized up to 200 bars (e.g., up to 250 bars) or a low pressure compressor that can be pressurized up to 80 bars (e.g., up to 50 bars).

The present disclosure also features a fuel purifier (also known as gas pollutant scrubber) that can remove contaminants in natural gas before natural gas is stored in the natural gas adsorption device described herein. Typically contaminants in natural gas include heavy hydrocarbons (i.e., hydrocarbons have at least 6 carbon atoms in a molecule), sulfur-containing compounds, and water. These contaminants generally are more readily adsorbed by the natural gas adsorption material described herein (e.g., activated carbon) than natural gas. In addition, these contaminants, once adsorbed, are relatively difficult to remove (e.g., by a simple depressurization). Moreover, these contaminants tend to accumulate over time or over multiple fueling cycles. As a result, these contaminants can reduce the adsorption capacity of the natural gas adsorption material described herein and therefore reduce its life.

Figure 7:
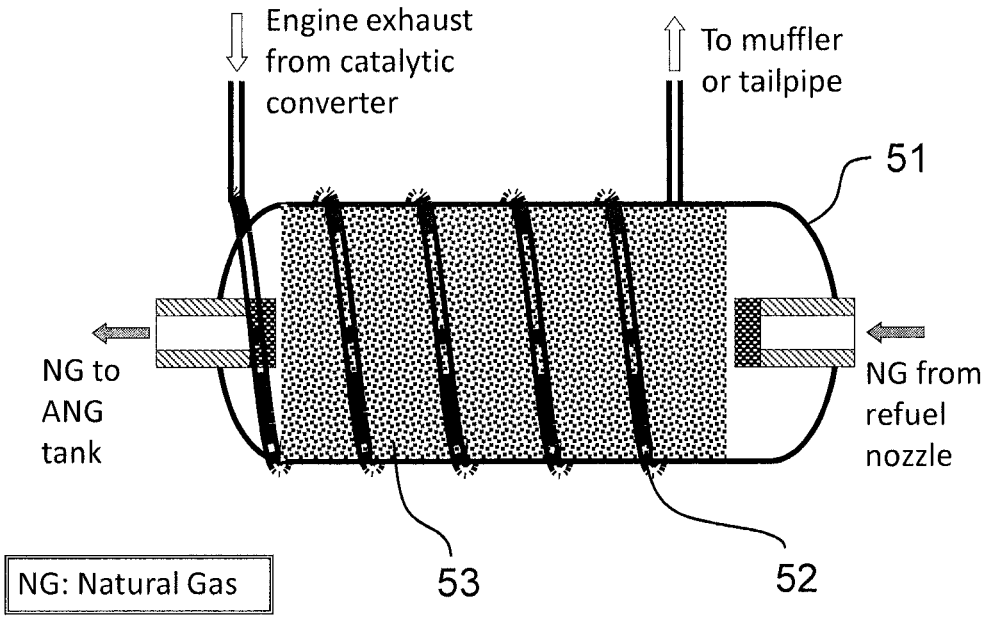
FIG. 7 illustrates an exemplary fuel purifier for trapping contaminants in a natural gas stream.

The fuel purifier described herein can be either replaced or reactivated (e.g., in situ) once its life is reached. For example, when the fuel purifier is used in combination with the natural gas adsorption device described herein on a vehicle, it can be simply replaced (much like an oil filter change) when its life is reached. Alternatively, the fuel purifier can be reactivated by heating (e.g., using heat from the engine exhaust). FIG. 7 shows an exemplary fuel purifier that can be used in a vehicle. The fuel purifier includes a vessel 51, a helical heating coil 52 that is wrapped around vessel 51, and an adsorbent 53 in vessel 51. Heating coil 52 can be attached to an engine exhaust from a catalytic converter at one end and attached to a muffler or tailpipe at the other end, such that the heat from the engine exhaust can be used to reactivate adsorbent 53 in vessel 51. Adsorbent 53 can be a material that captures or traps heavy hydrocarbons, sulfur-containing compounds, or water from a natural gas stream. Examples of suitable adsorbent 53 include activated carbon, activated charcoal, or zeolite. In some embodiments, the reactivation process can be automated.

The contents of all publications cited herein (e.g., patents, patent application publications, and articles) are hereby incorporated by reference in their entirety.

The following examples are illustrative and not intended to be limiting.

Example 1

Comparison Between the Flow Rate of an ANG Storage Tank Having a Filter Pouch Surrounding a Natural Gas Adsorption Material and that of an ANG Storage Tank without a Filter Pouch Two 1.26-liter ANG storage tanks were prepared as follows: Tank 1 was prepared by inserting a filter pouch made from a spunbond-meltblown-spunbond polypropylene fabric into the tank and then filled the pouch with adsorbent pellets (from 4 to 8 mesh in size). After the pouch was filled and sealed, the opening of the tank was fitted with a needle valve and a copper tubing having a 6 mm outer diameter (through which natural gas was transferred into and released from the tank). Tank 2 was prepared in the same manner as Tank 1 except that it did not include the filter pouch.

Tanks 1 and 2 were tested for their usage life by repeatedly filling natural gas into the tanks to reach a pressure of about 40 bars and then releasing natural gas from the tanks to reach a pressure of 1 bar through 40 cycles. The average flow rate from the tanks was measured by the volume flow of natural gas divided by the total amount of time needed to accomplish a pressure drop from 40 bars to 1 bar. For a proper working 1.26-liter ANG tank (i.e., a tank that is not clogged) fitted with the type of needle valve described above, the average flow rate of natural gas was about 63 seconds if the valve was fully open.

Figure 8:
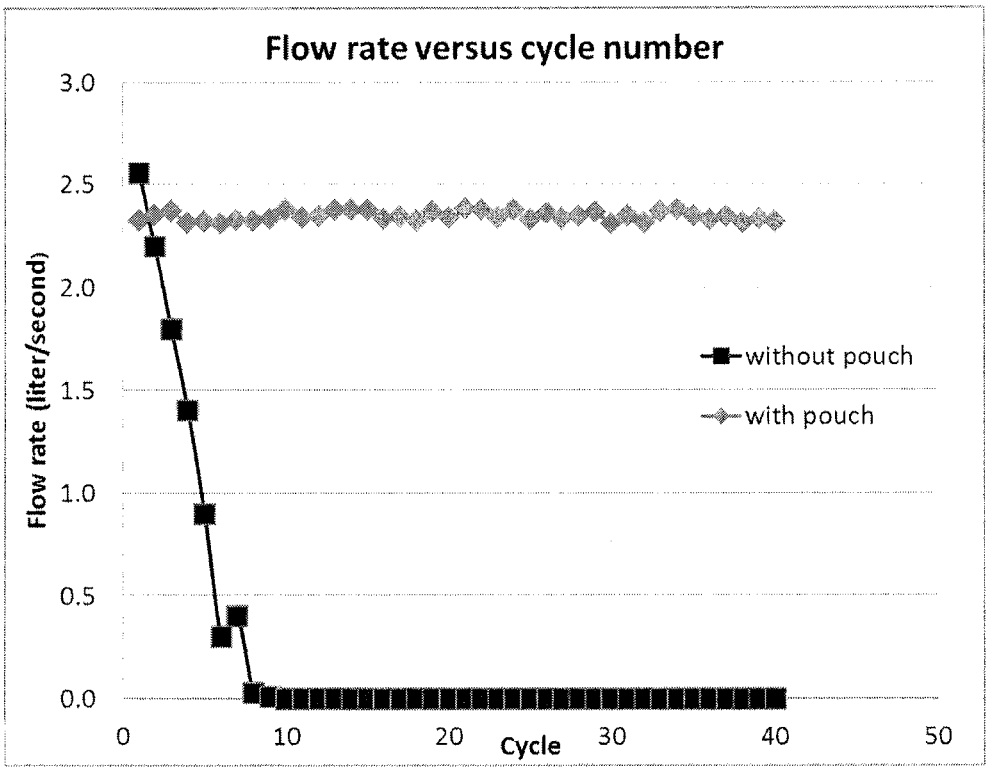
FIG. 8 is a graph showing the performance of an ANG storage tank using a pouch enclosing a natural gas adsorption material and an ANG storage tank without a pouch enclosing a natural gas adsorption material.

The test results are summarized in FIG. 8. As shown in FIG. 8, although the initial natural gas flow rate for Tank 2 was higher than that for Tank 1, it dropped quickly in the following cycles. In particular, the copper tubing for Tank 2 was completely clogged by dust generated from the natural gas adsorption material after only 9 cycles and had no noticeable flow thereafter. Unexpectedly, Tank 1 maintained a constant flow rate of natural gas at about 2.3-2.4 liter/sec throughout the entire 40 cycles.

Example 2

Comparison Between the Flow Rate of an ANG Storage Tank Having a Filter Pouch Surrounding a Natural Gas Adsorption Material and that of an ANG Storage Tank Having a Metal Mesh Filter at its Gas Inlet/Outlet Two 1.26-liter ANG storage tanks were prepared in the same manner as those described in Example 1 except that Tank 2 was fitted with a metal mesh filter at the gas inlet/outlet. The two ANG storage tanks were tested in the same manner as described in Example 1.

Figure 9:
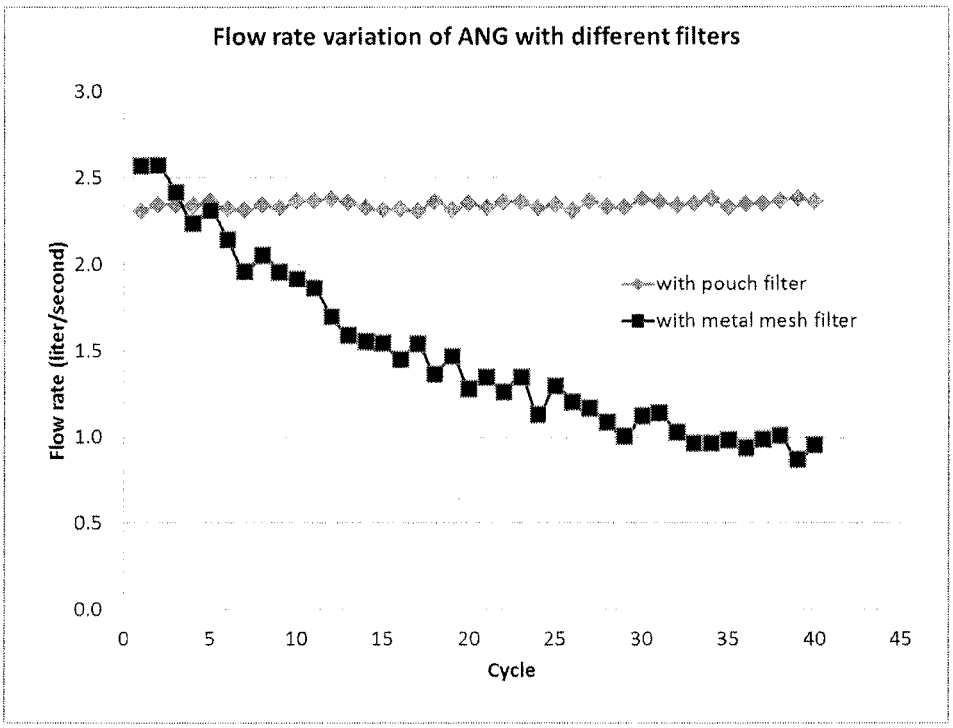
FIG. 9 is a graph showing the performance of an ANG storage tank using a pouch enclosing a natural gas adsorption material and an ANG storage tank using a metal mesh filter to prevent a natural gas adsorption material from entering into the fuel system.

The test results are summarized in FIG. 9. As shown in FIG. 9, Tank 1 maintained a constant flow rate of natural gas at about 2.3-2.4 liter/sec throughout the entire 40 cycles. By contrast, although Tank 2 in this example did perform better than Tank 2 in Example 1 (which does not have any filter), its flow rate dropped below half of that of Tank 1 in about 32 cycles. In other words, Tank 2 exhibited a much shorter life than Tank 1 and was therefore significantly inferior to Tank 1.

Other embodiments are within the scope of the following claims.

What is claimed is:

1. A natural gas adsorption device, comprising:

at least one porous, flexible container comprising at least one porous layer, the porous layer having an average pore diameter and is permeable to natural gas, a natural gas adsorption material at least partially disposed in the container, the material having a volume average diameter larger than the average pore diameter of the container, and a storage tank having an opening, the tank enclosing the container and the natural gas adsorption material, wherein the container comprises a material having a melting temperature of at least about 85° C. or a material having a glass transition temperature of at least about 85° C., and wherein the container comprises a material selected from the group consisting in fibrous or expanded film form, of glass, polyesters, polyacrylates, polymethacrylates, epoxy polymers, polyimides, polyvinyl alcohols, polyurethanes, polyacrylnitriles, polyolefins, polyphenylene sulfides, nylons, celluloses, polycarbonates, polyvinylidene fluorides, perfluoroalkoxy Polymers, fluorinated ethylene-propylene polymers, polytetrafluoroethylenes, polyamides, and copolymers thereof, and wherein the porosity of the container is formed by the gaps between the fibrous form of said materials in woven or non-woven form, or by expanding the film form of said materials.

2. The device of claim 1, wherein the container is formed on a surface of the natural gas adsorption material by a coating process.

3. The device of claim 1, wherein the container is formed on an inner surface of the tank.

4. The device of claim 1, wherein the natural gas adsorption material has a volume average diameter between about 0.001 mm to about 20 mm.

5. The device of claim 1, wherein the natural gas adsorption material comprises a material selected from the group consisting of activated carbon, carbon black, zeolites, activated graphite, carbon molecular sieve, activated charcoal, and mixtures thereof.

6. The device of claim 1, wherein the natural gas adsorption material is activated with a plasma discharge generated by electrical voltage.

7. The device of claim 1, wherein the natural gas adsorption material is activated by plasma initiated by a glow discharge.

8. The device of claim 7, wherein the glow discharge is generated by capacitive or inductive coupling from a plasma power source.

9. A vehicle, comprising an engine, and the natural gas adsorption device of claim 1.

10. The vehicle of claim 9, wherein the vehicle has dual NG refueling ports such that the vehicle is capable of being refueled by either a high pressure compressor that is capable of being pressurized up to 200 bars or a low pressure compressor that is capable of being pressured up to 80 bars.

11. The vehicle of claim 9, further comprising a fuel purifier that is upstream from the natural gas adsorption device and removes heavy hydrocarbons, sulfur-containing compounds or water from a natural gas stream.

12. The vehicle of claim 11, wherein the fuel purifier includes an absorbent comprising activated carbon, activated charcoal, or zeolite.

13. The vehicle of claim 11, wherein the fuel purifier uses engine exhaust heat to reactivate the absorbent in-situ.

14. The vehicle of claim 9, further comprising an induction heating apparatus surrounding the natural gas adsorption device, the apparatus being capable of heating the natural gas adsorption device to speed up release of natural gas.

15. The vehicle of claim 9, further comprising a natural gas pressure regulator capable of adjusting the pressure of natural gas before the natural gas is injected into the engine.

16. The vehicle of claim 9, wherein the vehicle is a motorcycle, a passenger vehicle, a truck, or a boat.

* * * * *